United States Patent [19]

Böttcher et al.

[11] 4,294,182

[45] Oct. 13, 1981

[54] DEVICE FOR APPLYING THREAD STAPLES TO FOLDED SHEETS

[75] Inventors: Winfried Böttcher; Kurt Germer, both of Leipzig, German Democratic Rep.

[73] Assignee: Veb Kombinat Polygraph "Werner Lamberz" Leipzig, Leipzig, German Democratic Rep.

[21] Appl. No.: 75,000

[22] Filed: Sep. 13, 1979

Related U.S. Application Data

[63] Continuation-in-part of Ser. No. 72,294, Sep. 4, 1979.

[30] Foreign Application Priority Data

Sep. 4, 1978 [DD] German Democratic Rep. ... 207622

[51] Int. Cl.[3] ..... B42B 1/02

[52] U.S. Cl. ..... 112/21; B42B/2/00

[58] Field of Search ..... 112/21, 22, 2, 304, 112/303, 11

[56] References Cited

U.S. PATENT DOCUMENTS 3,763,798 10/1973 Böttcher ..... 112/21
3,763,799 10/1973 Böttcher ..... 112/21
4,041,883 8/1977 Meratti ..... 112/21

FOREIGN PATENT DOCUMENTS 2210873 9/1972 Fed. Rep. of Germany ..... 112/21

*Primary Examiner*—Ronald Feldbaum
*Attorney, Agent, or Firm*—Michael J. Striker

[57] ABSTRACT

The device for piercing thread staples into folded sheets travelling in a plane includes an endless chain travelling at the same speed above the sheet feeding plane and supporting at regular intervals thread feeding plates which in turn support for a reciprocating movement a needle carrier with two needles having bifurcated points for engaging a thread length in the plate. The needle carrier supports two cam following rollers cooperating, respectively, with a stationary cam assembly above the chain. The cam assembly includes a lower cam for imparting a lifting movement to the needle carrier and a pivotable upper cam for imparting a lowering movement to the carrier against the sheet to be stitched. The upper cam cooperates with a solenoid which urges the same into its working position, and with a tensioning spring which urges the cam into its inoperative position against the force of the solenoid. A switch deactivates the solenoid when the upper cam is displaced by the resistance of the needles toward its inoperative position.

6 Claims, 4 Drawing Figures

DEVICE FOR APPLYING THREAD STAPLES TO FOLDED SHEETS

This application is a continuation-in-part application of my copending application Ser. No. 072,294, filed Sept. 4, 1979 and entitled APPARATUS FOR THE INSERTING OF THREAD STAPLES INTO SIGNATURES.

BACKGROUND OF THE INVENTION

This invention relates generally to book binding, and more particularly it relates to a device for piercing thread staples into folded sheets in which the lengths of thread corresponding to stitches or staples to be formed travel along a straight line together with the folded sheets to be stapled.

According to German publication DWP No. 95 831, a device of this type is known which is stationarily arranged above the feeding track for the sheets and includes three pairs of stitching needles travelling along a circular path on parallel crank gears, whereby the needles assigned to the parallel crank which runs to the lowermost position pierce the sheet fed on a straight line and travel along with the sheet for a relatively small part of its movement.

The disadvantage of this known drive results from the fact that even if the engaged needle moves uniformly with the sheet, the circular path circumscribed by the needle point does not match the rectilinear movement of the sheet. Accordingly, the speed difference during the piercing interval of the needles has to be corrected by additional matching gears. Inasmuch as the working speed of the device is about forty staples per second, the adjustment of the speed produces excessively high acceleration forces which due to the reversal of the mass movement forty times per second can be mastered only by the use of high precision manufacturing processes. Due to this high load, measures have to be found for preventing any wear of the movable component parts since otherwise excessively large perforations would result in the sheets.

Another disadvantage of the known device is connected with the design considerations for the drives of the sheet feeding means on the one hand, and of the parallel crank gears on the other hand. Even if the connecting members of the two drives are limited to a minimum the occurrence of play points between the run of the sheets and the run of the needles, and thus a deterioration in the accuracy of the piercing action, can be permanently avoided only with difficulties and at high costs.

The stitching or piercing step in this known system has to take place only during the half-cycle of the staple forming process. This requirement necessitates an excessively high stitching speed. In general, the speed limit attained by this known drive can hardly be exceeded.

Still other disadvantages arise in the event of an emergency stoppage when large masses have to be braked while the needles are in contact with the sheet and when in order to work without stitches, the gears have to be removable.

SUMMARY OF THE INVENTION

It is, therefore, a general object of the present invention to overcome the aforementioned disadvantages.

More particularly, it is an object of the invention to provide an improved device for applying thread staples to folded sheets which is capable of an increased accuracy of the stitching process at minimum wear of its component parts.

Another object of this invention is to provide a device of the aforedescribed type in which no high frequency acceleration of massive parts takes place.

Still another object of this invention is to provide such an improved device in which faulty stitches are eliminated.

A further object of this invention is to provide such an improved device in which a length of thread corresponding to a staple is introduced from the front side into the fork-shaped needle points.

An additional object of the invention is to provide such an improved device which is capable of achieving an increased staple forming speed relative to conventional devices of this type and in which the speed of the in-and-out movement of the needles can be adjusted at will irrespective of the mode of operation of the device.

Furthermore, an object of the invention is to provide such an improved device which makes it possible to temporarily stop the stitching function independently of the operation or stoppage of the transport system.

In keeping with these objects, and others which will become apparent hereafter, one feature of the invention resides, in a device for applying thread staples to folded sheets, in the provision of means for feeding the folded sheets in a plane, an endless articulated chain having a section travelling in the feeding direction of the sheets and parallel to this plane, a plurality of thread feeding plates attached to the chain and each carrying a length of the thread corresponding to the staples to be formed, a pair of needles supported on each plate and guided for a reciprocating movement to pierce the sheet and drive the thread therethrough, and stationary cam means to impart the reciprocating movement to the needles during the travel of the chain.

Preferably, the chain is in the form of an endless double-link chain of plates supported on three wheels and travelling at the same speed and in the same direction above the sheets to be stapled. The thread feeding plates are attached to the chain at regular intervals and guide in a known manner the length of the thread corresponding to a staple to be formed and press the same as well as the sheet against an underlying conveyor, such as, for example, a plate chain travelling at the same speed. According to this invention, each thread feeding plate supports a guiding column which in turn slidably supports a needle carrier with two cam following rollers projecting at opposite sides of the column to control the stitching movement of the needle carrier. A pair of needles is attached to the needle carrier to perform therewith a vertical movement along the guiding column. In the range of the straight travel of the double link chain, there is arranged a stationary control member in the form of a lifting control cam cooperating with a pressing control cam, the latter being coupled to a solenoid and controlled by a switch. The pressing control cam is at one end thereof pivotably supported on a pivot pin and the other end thereof is loaded with a tension spring, the vertical position of which is adjustable by means of a slider and a setting screw. The tension spring acts in an opposite direction than that of the solenoid. The solenoid biases the pivotable pressing cam downwardly to such a level in which each stapling or piercing step takes place. The stapling or piercing step is initiated when the roller for the downward drive of the needle carrier runs from below on the pressing control cam and thus drives the needle carrier with the two needles downwardly into the sheet. Upon completing the stapling step, the second roller on the needle carrier runs on the stationary lifting control cam and thus initiates the upward drive of the needle carrier which, upon reaching its upper position is maintained in the latter by means of a built-in pressure spring.

In the case when the downward movement of the needle carrier encounters an excessive resistance during the piercing action of the needles, the resulting pressure acting on the pivotable control cam lifts the latter and activates a switch or a light barrier which interrupts the energization of the solenoid. The pressing force of the solenoid is adjusted by the tension of the counteracting tension spring so that relatively weak forces suffice to activate the switch, thus causing an immediate upward movement of the pivotable control cam and of the needle carrier with the needles. In this manner, any damages which might result from an accidental interference such as, for example a jamming of sheets, breakage of needles and the like, is avoided. This protective function can also be performed by the design of the device in which the chain wheel of the double link chain situated downstream of a sealing rail is supported for a swinging movement together with the entire system about the axis of the chain driving wheel which takes place upstream of the sealing rail. Also, this design makes it possible to immediately displace the stitching needles from the rank of a jammed sheet.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
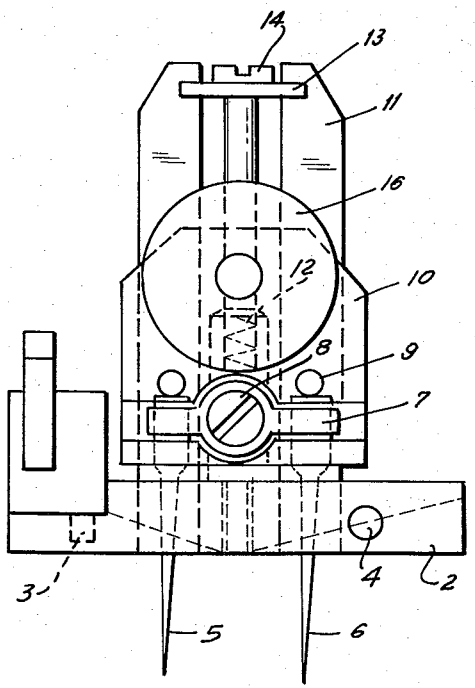
FIG. 2 is a side view of the unit of FIG. 1 shown in the piercing position of its needles.
Figure 1:
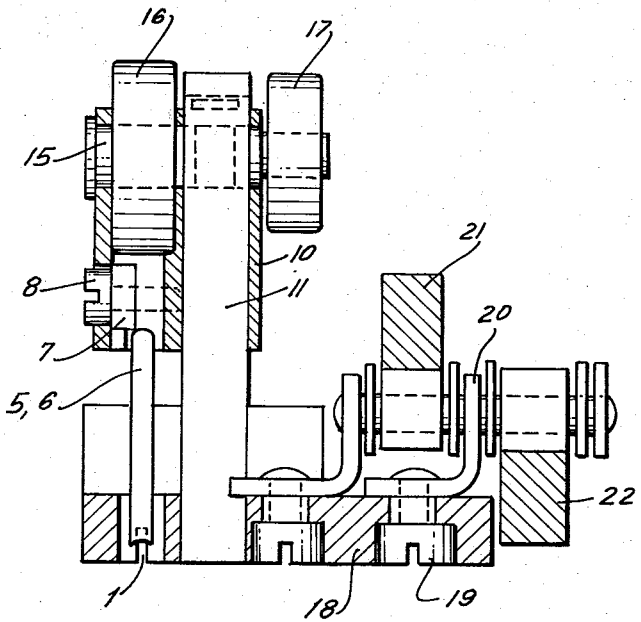
FIG. 1 is a rear view, partly in section, of a thread feeding plate with a thread staple forming unit according to this invention.
Figure 3:
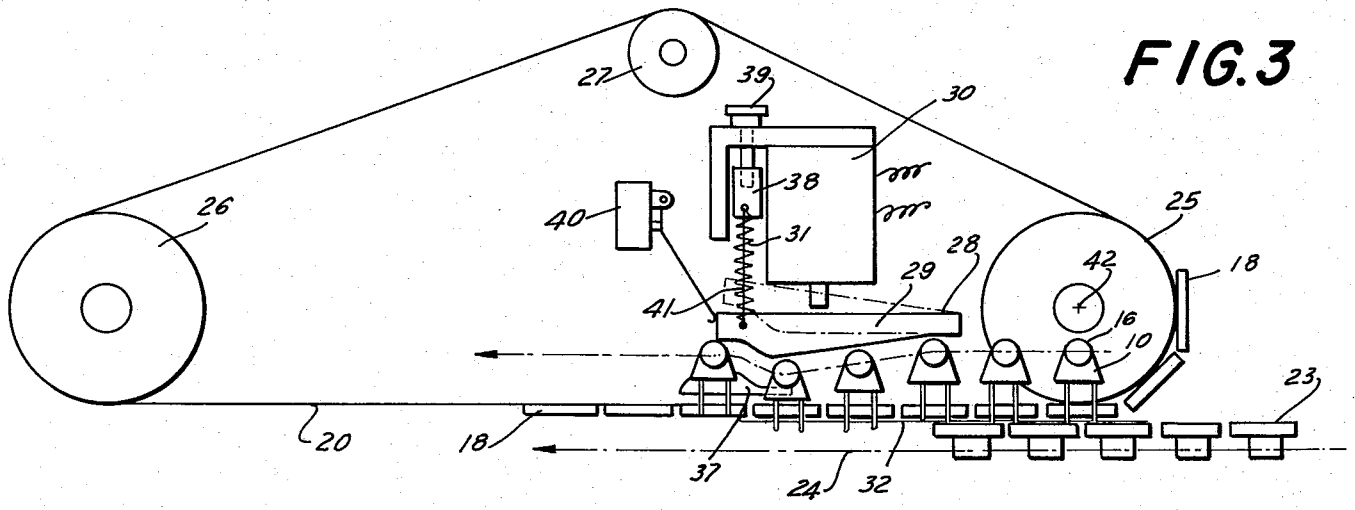
FIG. 3 is a schematic side view of the device for applying the staples to folded sheets according to this invention, including a double link driving chain with a plurality of units of FIG. 1 and cooperating with a cam assembly.
Figure 4:
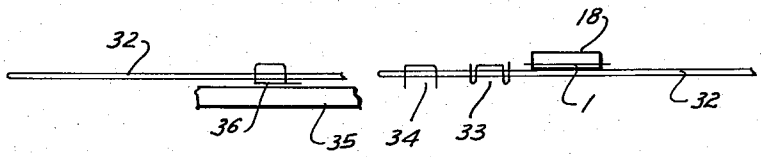
FIG. 4 shows the successive phases during the formation of a thread staple in a folded sheet.

A sealable (usually heat-sealable) thread 1 is inserted by a non-illustrated means into a groove 2 of a thread feeding plate 18 and held therein in position by means of tensioning prongs 3 and a clamping member 4. During the insertion of the thread 1 into the groove 2, needles 5 and 6 together with the needle carrier 10 are in the lifted position as illustrated in FIG. 1. The needles 5 and 6 abut against stop pins 9 and are fastened to the needle carrier 10 by means of a clamping plate 7 and a fastening screw 8. The needle carrier 10 is slidably guided on two upright columns 11 and is urged into its elevated rest position (FIG. 1) by means of a built-in pressure spring 12. A stop plate 13 with a fastening screw 14 acts as a limit stop for the needle carrier 10. Two rollers 16 and 17 are rotatably supported on the needle carrier 10 by means of a pivot axle 15. The roller 16 at one side of the columns 11 serves for imparting a downward movement to the carrier 10, whereas the roller 17 at the other side of the columns 11 imparts an upward or lifting movement to the carrier. The guiding columns 11 are secured to the thread feeding plate 18 and the latter is fastened by screws 19 to a travelling double link chain 20. The moving rails 21 and 22 of the chain 20 serve for guiding the latter and also as an abutment against the pressing forces from the sheet conveyor 24. Plates 23 of the counteracting sheet conveying chain 24 which moves simultaneously with the chain 20, are illustrated in FIG. 3. The double link chain 20 for moving the thread feeding plates 18 is driven by wheels 25, 26 and 27 in the direction of the sheet feeding chain 24 as indicated by arrow. In the range of the parallel movement of the straight section of the double link chain 20 and of the facing sheet feeding chain 24, a control cam assembly 29 and 37 is arranged above the double link chain 20. This cam assembly includes a stationary lower cam 37 and a pivotable upper cam 29 supported at one end for rotation about a pivot pin 28. The upper cam 29 is urged into its operative position as illustrated in full line in FIG. 3 by means of a solenoid 30. The free end of the pivotable upper cam 29 is attached to a tensioning spring 31 which urges the cam against the force of the solenoid 30 as will be explained in more detail below. As long as the pivotable upper cam 29 is held by the solenoid 30 in its depressed operative position the lowering rollers 16 on needle carriers 10 displace the latter and thus the needles 5 and 6 into their piercing position as shown in FIG. 2. Only when solenoid 30 is deenergized no movement of the needles takes place inasmuch as the pivotable upper cam 29 is displaced by the tensioning spring 31 into its elevated position 41 as indicated by the dashed line. As soon as the solenoid 30 is activated, the pivotable cam 29 moves downwardly and the bifurcated tips of needles 5 and 6 pierce the folded sheets 32 and introduce the ends of thread 1 from the groove in the thread feeding plate 18 (FIG. 4) into the perforations to form the stitches 33 resulting in the thread staple 34. The projecting ends of the thread staple 34 (the thread contains thermoplastic components) move against a heated stationary sealing rail 35 and are bent and sealed at points 36 to the sheet 32. Before the thread staple 34 reaches the sealing rail 35, the lifting roller 17 of the needle carrier 10 runs on the stationary lower cam 37 and displaces the carrier 10 with the needles to the elevated position as shown in FIG. 1.

In the case of a disturbance in the sheet feeding process, such as a jamming of the sheet, a breakage of a needle and the like, no subsequent working steps should be performed and immediate safety measures have to be initiated at the high working speed of the device. One of these measures is a swing-up movement of the wheel 26 together with the thread feeding chain 20 about a pivot point 42 at the center of wheel 25. Simultaneously the electric current supplied to the solenoid 30 is interrupted and consequently the movement of the needles 5 and 6 is discontinued and in addition the operation of the whole system is stopped. It is also possible to use direct measures to safeguard the needles. For this purpose, a standard piercing pressure of the needles for a processed sheet material is determined and accordingly the counteracting force of the pivotable upper cam 29 is adjusted by reducing the effective pressure of the activated solenoid 30. The pressure reduction is effected by adjusting the tensioning spring 31 via the slider 38 and the setting screw 39. If the standard piercing pressure is even slightly exceeded the resulting counter pressure slightly lifts the pivotable upper cam 29 together with the plunger of the solenoid. During this minute lifting movement the switch 40 or a non-illustrated light barrier is actuated and immediately turns off the current supply for the solenoid, thus preventing any stitching operation and releasing additional safety impulses which might be necessary for the stopping of the system.

It will be understood that each of the elements described above, or two or more together, may also find a useful application in other types of constructions differing from the types described above.

While the invention has been illustrated and described as embodied in a thread stapling device for book sections, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for applying thread staples to folded sheets, comprising means for feeding said sheets in a plane; an endless chain having a section travelling in said plane in the feeding direction of the sheets; a plurality of thread feeding plates attached to said chain and each carrying a length of the thread corresponding to a staple to be formed; a pair of needles supported on each plate and guided for a reciprocating movement relative to said threads and said sheet; and stationary cam means operable to impart said reciprocating movement to said needles during the travel of said chain.

2. The device as defined in claim 1, wherein said thread feeding plates support, respectively, at least one guiding column, a spring-biased needle carrier slidably guided on said column and supporting at each side of the column a cam following roller.

3. The device as defined in claim 2, wherein said cam means include a lower cam for engaging one of said cam following rollers on said needle carrier to impart a lifting movement to the latter and an upper cam for engaging the other cam following roller to impart a lowering movement to said needle carrier.

4. The device as defined in claim 3, wherein said upper cam is at one end thereof supported for a rotary movement between a lower working position and an upper inoperative position, a solenoid having its plunger linked to said upper cam to urge the same into its working position when actuated and a tension spring linked to the free end of said upper cam to urge the same into said inoperative position against the force of said solenoid.

5. The device as defined in claim 4; further including a switch operated by said pivotable upper cam to interrupt the operation of said solenoid when said upper cam is displaced towards its inoperative position.

6. The device as defined in claim 4, wherein said endless chain is supported on at least two driving wheels, one of said wheels together with a chain being swingable about the axis of the other wheel.

* * * * *